US005441441A

United States Patent [19]

Cook et al.

[11] Patent Number: 5,441,441

[45] Date of Patent: * Aug. 15, 1995

[54] METHOD FOR REMOVAL OF SURFACE CONTAMINANTS FROM CONCRETE SUBSTRATES

[76] Inventors: Jack R. Cook, P.O. Box 1409, Farmington, N. Mex. 87499; Loren L. Hatle, 1903 Central Blvd., Rapid City, S. Dak. 57702

[ * ] Notice: The portion of the term of this patent subsequent to Jun. 7, 2011 has been disclaimed.

[21] Appl. No.: 31,695

[22] Filed: Mar. 15, 1993

Related U.S. Application Data

[63] Continuation-in-part of Ser. No. 9,283, Jan. 26, 1993, Pat. No. 5,317,841, which is a continuation-in-part of Ser. No. 938,202, Aug. 28, 1992, abandoned.

[51] Int. Cl.[6] ..... B24C 1/00

[52] U.S. Cl. ..... 451/36; 451/38; 451/99

[58] Field of Search ..... 51/319, 320, 321, 323, 51/281 R, 410, 424, 427, 428, 431, 432; 451/28, 36, 37, 38, 39, 40, 75, 87, 88, 90, 91, 99, 100

[56] References Cited

U.S. PATENT DOCUMENTS

| | | | |
|---|---|---|---|
| 3,950,642 | 4/1976 | Feld | 51/320 |
| 4,020,857 | 5/1977 | Rendemonti | 51/320 |
| 4,258,505 | 3/1981 | Scheiber | 51/317 |
| 4,583,329 | 4/1986 | Lang | 51/319 |
| 4,729,770 | 3/1988 | Higgins | 51/319 |
| 4,878,320 | 11/1989 | Woodson | 51/410 |
| 5,123,206 | 6/1992 | Woodson | 51/319 |
| 5,182,882 | 2/1993 | Brodene et al. | 51/317 |
| 5,302,324 | 4/1994 | Morikawa et al. | 51/320 |
| 5,317,841 | 6/1994 | Cook et al. | 51/321 |

*Primary Examiner*—Maurina T. Rachuba
*Attorney, Agent, or Firm*—David M. O'Brian

[57] ABSTRACT

A method is disclosed for removing water soluble salts from a concrete substrate in a wet blast system in which a bicarbonate abrasive is blasted in a high purity pressurized water stream against the surface of the concrete substrate to prepare the surface for the application of a coating. The method includes the steps as indicated in FIG. 8 in which a high pressure wet blast of high purity pressurized water and sodium bicarbonate abrasive is first applied by a nozzle (14) against the surface of the concrete substrate with the water soluble salts being removed or neutralized. Next, a high purity pressurized water without abrasive is applied by the nozzle (14) against the surface of the concrete substrate for washing the surface clean and removing the neutralized water soluble salts. The water for the wet blast system is of a very high purity characterized by a conductivity of between 0.5 and ten (10) micromohs/cm.

6 Claims, 1 Drawing Sheet

METHOD FOR REMOVAL OF SURFACE CONTAMINANTS FROM CONCRETE SUBSTRATES

CROSS REFERENCE TO RELATED APPLICATIONS

This application is a continuation-in-part of parent application Ser. No. 08/009,283 filed Jan. 26, 1993, now U.S. Pat. No. 5,317,841; which is a continuation-in-part of application Ser. No. 938,202 filed Aug. 28, 1992, now abandoned.

FIELD OF THE INVENTION

This invention relates to a method for the removal of surface contaminants from substrates in general, and more particularly to such a method in which an abrasive material is blasted in a pressurized water stream against the surface of concrete substrates for cleaning the surface.

BACKGROUND OF THE INVENTION

Various coatings are applied to metal substrates. It is highly desirable that the metal substrate be effectively cleaned of contaminants prior to the application of the coating so that the useful coating life may be prolonged. Contaminants include liquid halogens, sulfur compounds, and occasionally nitrogen compounds. Such surface contaminants include water soluble salts, such as chlorides, sulfates and nitrates. On steel substrates such salts are iron salts (ferrous and ferric salts.)

Various coatings are also applied to concrete substrates. Concrete is of course different from metals such as steel in that it is not chemically reactive with water soluble salts such as sodium chloride.

The presence of water soluble salts on substrates has long been recognized as a major factor in reducing coating life. The detrimental effect of these contaminants on coating performance has been discussed in coatings related literature for almost 30 years. Water soluble salts on a substrate initiate coating disbondment (and substrate corrosion) through an osmotic blistering process which is described below.

In the event of a media blasted steel substrate, ferrous chloride is formed whenever steel or iron and soluble chloride in moisture are in contact. This reaction, in itself, is a strong corrodant of steel surfaces. Upon exposure to air, ferrous chloride oxidizes to ferric chloride, a hygroscopic salt with a natural affinity for moisture in the air. Trace amounts of either ferric or ferrous chloride remaining on the substrate accumulate moisture from the air resulting in the formation of a concentrated iron chloride solution on the surface of the steel substrate. Iron ions, chloride ions and water comprise an electrolytic solution that drives an electrochemical corrosion reaction. Coatings applied over such a substrate fail in a short period of time due to the concentrated iron chloride solution on the substrate drawing water through the coating by osmosis and creating a blistering or disbondment of the coating. Rates of coating failure due to osmotic blistering are dependent on the thickness and porosity of the coating.

Concrete is a cast material that is porous by nature. The porosity of concrete may provide water and air pockets extending from the surface into the material to a depth of one inch. The amount of porosity varies with the method of casting of the cement and the type of finish applied. Hard troweling of the surface minimizes porosity.

Contamination of substrates from soluble salts has been identified as the source of coating failure and has been thoroughly documented. Practical cost effective solutions to the problem have eluded routineers in the coating science field. Complicating the search for cost effective solutions is the lack of standards defining acceptable levels of soluble salt contaminations or concentrations on substrates. The level of cleanliness required varies significantly with the service environment and the characteristics of the coating selected. However, independent of these variables, "the cleaner the substrate, the greater the resistance to coating disbondment".

Until recently, blast cleaning specifications have not addressed removal of non-visible surface contaminants. Conventional grit blasting techniques were not designed to remove ionic contamination. Dry abrasive blasting can not efficiently remove localized sources of corrosion initiation sites (commonly referred to as corrosion cells) because an operator may not be able to see such contaminants and direct a dry grit blast against such corrosion initiation sites. Efforts to develop methods for removal of these non-visible contaminants from substrates, both metal and concrete, have been generally unsuccessful although several techniques have been tried with partial success, such as, for example, (1) dry blasting followed by water rinsing (several cycles), (2) hard grit wet abrasive blasting, (3) high pressure washing, and (4) acid washing followed by water rinsing.

The coating performance of concrete substrates is affected primarily by two problems. One problem involves the formation of a thin layer of non-reactive materials on the surface of cured new concrete as a residue. The residue forms a weak powdering material with little adhesive strength and therefore is not acceptable for the subsequent application of a coating material over the surface of the concrete. The other problem is that uncleaned concrete of any age contains water soluble salts in the voids. These salts create the same hygroscopic condition that salt contaminants in steel create as a microscopic layer of water is always present on the substrate surface regardless of temperature and humidity conditions, due to the hydroscopic nature of the salt contaminants. Coatings applied over salt contaminated surfaces fail in a short period of time due to poor adhesion caused by osmotic blistering.

Also, particularly when horizontal concrete surfaces are etched with acid, such as hydrochloric or muriatic acid, the reaction of the acid with the cement creates soluble salts which are present in the pores of the concrete. The removal of such soluble salts heretofore has been attempted by the use of a stiff bristle broom and copious amounts of rinse water which in many instances have been ineffective to remove the salts.

SUMMARY OF THE INVENTION

The present invention is particularly directed to a method for the removal of surface contaminants from concrete substrates including as a first step the blasting with an abrasive, such as sodium bicarbonate, in a pressurized stream of water against the surface of the substrate with the water having a high purity. After the abrasive blast against the concrete substrate, a pressurized high purity water wash is applied against the surface of the concrete substrate in a second step. The abrasive scrubbing action in the first step removes any surface residue on the concrete and displaces soluble salts from the pores of the concrete. The second step utilizing the high purity water wash readily dissolves and removes the water soluble salts, other surface contaminants, and any residual abrasive material. The treatment of the surface of the concrete substrate in accord with the process described above results in a superior cleaned surface that is free of any detectable ionic contaminants and prepares the concrete surface for application of a suitable coating for enhancing the coating life.

One particular use of the present method for removing surface contaminants from concrete substrates is on concrete surfaces on which acid etching has been performed to achieve the desired surface profile on horizontal concrete surfaces. Acid etching is usually accomplished with hydrochloric or muriatic acid although sulfamic, phosphoric, or citric acid may be used for etching under various conditions. The acid etching process creates water soluble salts which are in addition to the soluble salts already present in the concrete. The residual unreacted acid together with the soluble salts formed by the reaction and those previously existing in the concrete must be completely removed.

Testing of the cleaned surface is performed to confirm the results. Using an abrasive material, such as sodium bicarbonate, and water of a high degree of purity (e.g., less than around ten (10), preferably less than five (5) micromohs/cm), a high level of cleaning action is achieved as a result of the following interacting factors:

1) the abrasive, scrubbing action of the sodium bicarbonate particles on the concrete substrate achieved by the combined effect of the hardness of the sodium bicarbonate particles and the impact velocity attained by the accelerating action of the high pressure water jet at a pressure between around 1,500 psi and 5,000 psi with an optimum pressure of around 3,000 psi, 2) the chemical action, in the form of a neutralization reaction, of the sodium bicarbonate on the ionic contaminants in the pores of the concrete substrate, and 3) the medium pressure washing at a pressure between around 500 psi and 10,000 psi to remove neutralized soluble salts, impacted particles, and other surface contaminants from the concrete substrate.

A variety of tests may be utilized to test the presence of soluble salts such as sodium chloride. Some tests are effective to measure sodium chloride (Na Cl) but only to around forty (40) ppm, based on a dilution of 10 ml of water per 100 square cm of substrate. Concentrations below the sensitivity of a test are negligible or "zero-detectable".

The water used in the blast operation is deionized water as pure as possible with a ph range between six (6) and eight (8) and having a conductivity of between 0.5 and ten (10) micromohs/cm. Pure water by nature has a Ph close to neutral. Ionic contaminants (i.e., salts) in the pores of concrete tend to attract moisture which results in a hygroscopic condition. In order to remove the residual ionic contaminants from the concrete substrate, an ultra pure water is used in water propelled abrasive cleaning of the substrate surface to avoid recontaminating the concrete with impurities in the water.

Reference is made to U.S. Pat. No. 4,878,320 dated Nov. 7, 1989 for an illustration of a suitable apparatus for water propelled abrasive cleaning, the entire disclosure of which is incorporated by this reference. A suitable discharge nozzle is shown in U.S. Pat. No. 4,878,320 for applying a high pressure stream of water and sodium bicarbonate particles. A compressor provides pressurized supplies of water and air to the nozzle and a hopper provides a pressurized supply of sodium bicarbonate particles to the nozzle where the particles are propelled by a jet of water against the substrate surface. One use of the present method has been for the cleaning of concrete structures which must be coated such as bridge structures, floors, and tanks.

An object of this invention is to provide a method for the removal of surface contaminants from concrete substrates where the method is particularly adapted for the removal of water soluble salts such as sodium chloride from the surface of a concrete substrate.

Another object of this invention is to provide such a method for the removal of water soluble salts from horizontal concrete substrates on which acid etching has been performed creating water soluble salts within the pores of the horizontal concrete substrates.

Another object of this invention is to provide such a method for the removal of surface contaminants from concrete substrates utilizing a high pressure water blast system having a sodium bicarbonate abrasive material therein.

A further object of the invention is to provide such a water blast method utilizing an abrasive with water of superior purity of less than about five (5) micromohs/cm so that mechanical removal or chemical neutralization of ionic contaminants occurs.

The following drawings illustrate apparatus for carrying out the method of this invention and the steps involved in the method.

DESCRIPTION OF THE INVENTION

Figure 1:
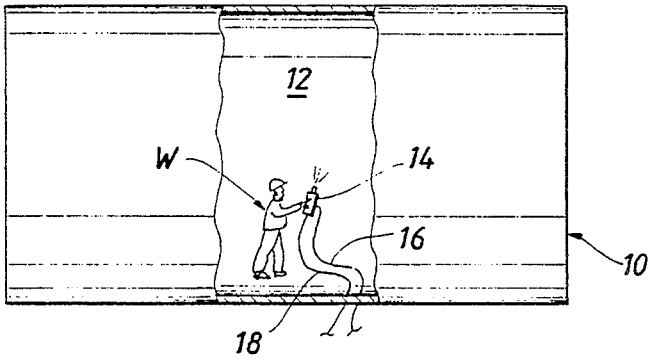
FIG. 1 is an elevational view, partly schematic, illustrating the method of the invention for removing surface contaminants from the inner surface of a concrete tank prior to application of a coating.

Referring to FIG. 1, a workman W is shown within the interior of a concrete cylindrical tank generally indicated at 10 which has an inner surface 12 to be treated and cleaned for removing surface contaminants prior to application of a coating. Although the interior of a concrete tank is selected for illustration of the invention, other structures or surfaces of concrete may be cleaned using the method of this invention.

Inner surface 12 may have already been preliminarily cleaned as by conventional dry abrasive blasting, such as sand blasting, etc. Alternatively, such preliminary cleaning may be performed by wet abrasive blasting, high pressure water blasting, hand tools, etc. The workman W grips a nozzle 14 connected to suitable supply lines for the application of high pressure water and an abrasive material from a predetermined orifice against the surface of the concrete substrate. Nozzle 14 has a propulsion chamber with high pressure water supplied through line 16 to such propulsion chamber. Abrasive, preferably sodium bicarbonate, is supplied with a stream of pressurized air through line 18 to the propulsion chamber of nozzle 14.

Figure 2:
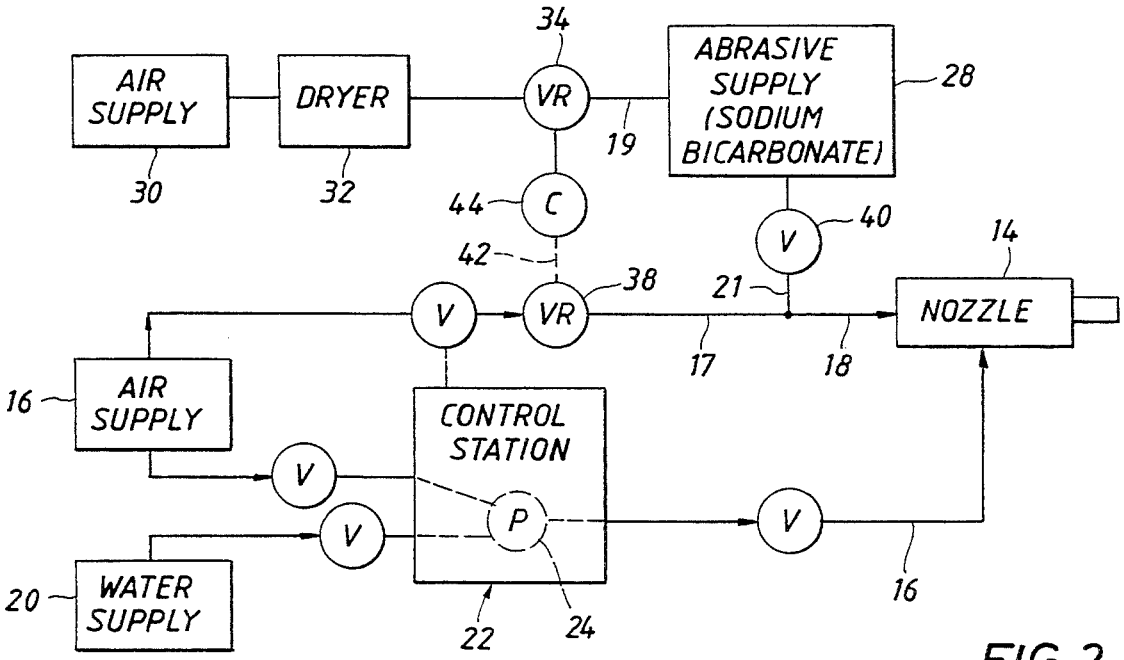
FIG. 2 is a schematic view of a wet abrasive blast system used in FIG. 1 with the method of the present invention.

Referring to FIG. 2, an apparatus which has been found to be satisfactory in carrying out the method of this invention is illustrated schematically. A water supply 20 supplies water of a superior purity to a control station 22. A high pressure water pump 24, driven by an air supply 15, supplies pressurized water through line 16 to nozzle 14 at a pressure generally between 500 psi and 10,000 psi (preferably between 1,500 psi and 5,000 psi). A supply of water soluble abrasive, preferably sodium bicarbonate, is shown at 28 in a supply hopper or "pot". Air under pressure passes from air supply 30 through a dryer 32 and a regulator valve 34 to hopper 28. Air to convey the abrasive to nozzle 14 is supplied from air supply 15 and regulator valve 38 to supply line 18. A metering valve 40 is provided for metering the abrasive material from hopper 28 to line 18. A pressure differential of around 2–5 psi is provided between the pressure in hopper 28 and the pressure in conveying line 18 to provide a suitable abrasive flow by gravity and differential pressure from hopper 28 to conveying line 18. Dryer 32 insures that no liquid phase water is present in the air supply to hopper 28. While a dried air supply is illustrated for pressurization of hopper 28, it is to be understood that other gases may be used satisfactorily such as nitrogen, argon, or hydrogen, for example. A dryer at the output of air supply 15 may be provided to dry air applied to conveying line 18, but dry gas applied to air line 17 is not essential whereas dry gas applied to hopper 28 via line 19 is essential to prevent clogging of the water soluble abrasive at the exit line 21 of the hopper.

Pressure regulators 34 and 38 are coupled to each other through line 42 having a pressure control 44 therein so that the internal pressure in hopper 28, which contains sodium carbonate particles, is always greater than the pressure in line 18. For further details of the apparatus, reference should be made to the aforementioned U.S. Pat. No. 4,878,320.

Figure 3:
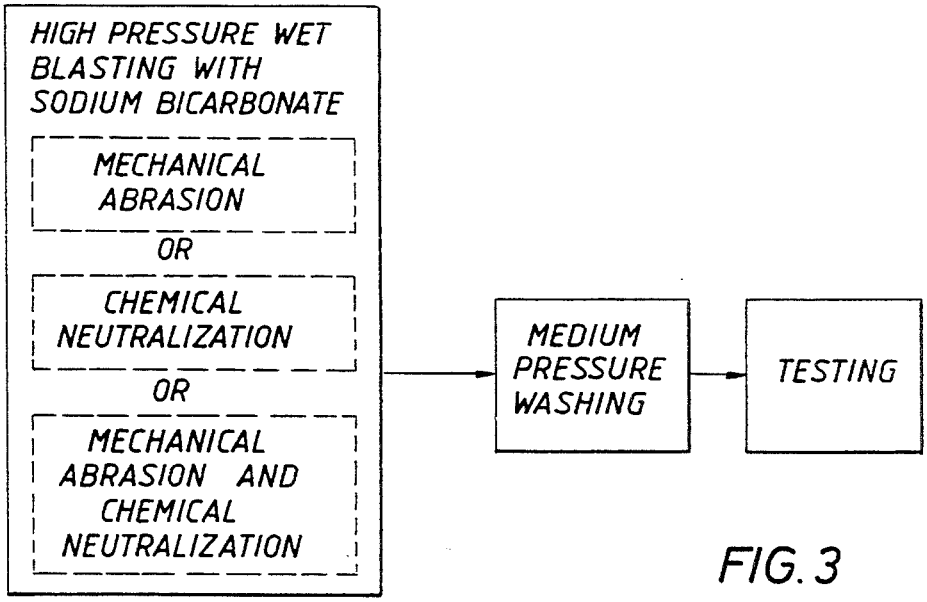
FIG. 3 is a schematic view illustrating the sequential steps involved in carrying out the method of the invention.

FIG. 3 illustrates diagrammatically the steps involved in the method of the present invention in which high pressure water of a superior purity and sodium bicarbonate are first applied against the surface of a concrete substrate. The mechanical action of the abrasive against containments may remove such contaminants to a certain purity level. Such step may also involve a chemical action comprising a neutralization action by the sodium bicarbonate of any remaining ionic contaminants. In other words, the first step of wet abrasive blasting may include mechanical abrasion of the contaminants or chemical neutralization of contaminants or both mechanical abrasion and chemical neutralization.

Next, a pressurized washing with the superior purity water at a pressure generally between 200 psi and 20,000 psi is provided against the substrate to remove the neutralized soluble salts and other surface contaminants. Next, a test is provided on the surface of the substrate to confirm the absence of any salts of an amount greater than one (1) equivalent ppm.

The process described above solves two coating related problems with respect to cast concrete.

The first problem concerns the fact that new cured concrete has "laitance" on the surface. Laitance is not a part of the concrete matrix, but is a thin layer of nonreactive materials in the cement which are present as a surface residue. Laitance forms a weak powdery material with little adhesive strength. Laitance is removed from a concrete surface by the process described above.

The second concerns the fact that concrete of any age contains salts in its voids. Such salts, though not reactive with the concrete itself, creates an hygroscopic condition on the surface of the concrete. A microscopic layer of moisture is always present on the concrete surface regardless of temperature and humidity conditions due to the hygroscopic nature of such salt contaminants. Coatings applied over such a surface fail in a short time due to osmotic blistering and poor adhesion. The process described above applied to a concrete surface displaces the soluble salts from the pores in the concrete by physical abrasion and chemical action, leaving a clean coatable concrete surface.

The cement in concrete is alkaline and chemically reactive particularly with acids. A common method of obtaining a surface profile on horizontal concrete surfaces is by acid etching preferably using hydrochloric or muriatic acid but also at times utilizing sulfamic, phosphoric, or citric acid. While acid etching is effective in establishing a surface profile, the etching process creates water soluble salts with the following reaction:

$$2HCL + CaCo_3 \longrightarrow CaCl_2 + H_2O + CO_2\uparrow$$

acid — cement — soluble salt — water — gas

The water soluble salts present after acid etching include in addition to the newly created water soluble salts (1) the water soluble salts present in the concrete prior to acid etching and (2) residual ions and reaction products from the acid used in the acid etching process. It is necessary that any residual unreacted acid together with the water soluble salts be removed completely in order to provide an adequate concrete surface for subsequent coatings. The method as set forth above for removing surface contaminants from concrete substrates is utilized for the removal of the water soluble salts from the acid etched concrete surfaces but includes the following distinct characteristics as a result of this process.

The first characteristic comprises an abrasive scrubbing action and intimate contact of the sodium bicarbonate based particles on the concrete substrate achieved by the combined effect of the hardness of the particles and the velocity/impact (momentum) attained by the accelerating action of the water jet.

The second characteristic comprises the chemical action, in the form of a neutralization reaction of the sodium bicarbonate on the residual acid in the concrete substrate. The neutralization reaction is as follows:

$$HCL + NaHCO_3 \longrightarrow NaCl + H_2O + CO_2\uparrow$$

acid — chemically active abrasive — neutral salt — water — gas

The third characteristic comprises the high purity medium pressure water wash to remove soluble salts, neutralized acid and other surface contaminants.

Thus, the above process neutralizes the residual acid contaminants rather than attempting to dilute the contaminants to an acceptable level as heretofore accomplished by repeated rinsing.

At times, it is possible that an unreacted acid is present as a contaminant in the concrete substrate without being applied in an acid etching process and thereby provides an "acid contaminated" concrete. Such an acid contaminated concrete is normally of a significant depth and not a thin outer layer since the acid has not been applied in a controlled process. However, the present process will mechanically and chemically remove the contaminants from such acid contaminated concrete and provide a concrete surface having a structural and chemical integrity ideal for subsequent coating.

While sodium bicarbonate has been illustrated as the preferred abrasive material, other abrasive materials for neutralizing soluble salts, particularly bicarbonate materials, such as potassium bicarbonate or ammonium bicarbonate may be used under certain conditions and provide satisfactory results.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method for removing salts from a concrete substrate utilizing a source of pressurized water, and a source of a bicarbonate abrasive; said method comprising the steps of:

applying pressurized water and the bicarbonate abrasive against the surface of said concrete substrate at a predetermined high pressure so that water soluble salts on the surface of said concrete substrate are physically removed or chemically neutralized or both physically removed and chemically neutralized; and then applying pressurized water at a predetermined pressure against the surface of said concrete substrate so that any neutralized salts are removed from the surface of said concrete substrate.

2. The method as set forth in claim 1 wherein said water of said applying pressurized water steps is characterized by a conductivity between about 0.5 and ten (10) micromohs/cm.

3. A method for removing salts from the surface of a concrete substrate to prepare said surface for the application of a predetermined coating and utilizing a fluid discharge nozzle operatively connected to a source of pressurized water, and a source of bicarbonate abrasive entrained in a stream of air for neutralizing the salts; said method comprising the steps of:

providing a water supply line to said nozzle;

providing a separate gas pressurized bicarbonate abrasive supply line from said abrasive source to said nozzle for the discharge of pressurized water and bicarbonate abrasive from said nozzle against the surface of said concrete substrate so that water soluble salts on the outer surface of said substrate are neutralized; and then applying pressurized water at a predetermined pressure against the outer surface of said concrete substrate for washing neutralized salts from the outer surface of said concrete substrate thereby to prepare the outer surface of said substrate for the application of a coating.

4. A method for removing salts as set forth in claim 3 wherein said pressurized water has a conductivity between around 0.5 and ten (10) micromohs/cm.

5. A method for removing water soluble salts from the surface of an acid etched concrete substrate to prepare said surface for the application of a predetermined coating and utilizing a fluid discharge nozzle operatively connected to a source of pressurized water, and a source of bicarbonate abrasive entrained in a stream of air for neutralizing the salts, said water soluble salts including water soluble salts created by the reaction of the acid with the cement in the concrete substrate; said method comprising the steps of:

providing a water supply line to said nozzle;

providing a separate gas pressurized bicarbonate abrasive supply line from said abrasive source to said nozzle for the discharge of a high purity pressurized water and bicarbonate abrasive from said nozzle against the surface of said concrete substrate so that water soluble salts on the outer surface of said substrate are neutralized; and then applying pressurized water of a high purity at a predetermined pressure against the outer surface of said concrete substrate for washing neutralized salts and any residual unreacted acid from the outer surface of said concrete substrate thereby to prepare the outer surface of said substrate for the application of a coating.

6. A method for removing water soluble salts as set forth in claim 5 further including the steps of:

testing the surface of said concrete substrate to confirm the absence of any salts on an amount greater than one (1) equivalent ppm; and providing said high purity pressurized water having a conductivity between around 0.5 and ten (1) micromohs/cm.

* * * * *